US007104606B2

(12) United States Patent
Congleton et al.

(10) Patent No.: US 7,104,606 B2
(45) **Date of Patent: *Sep. 12, 2006**

(54) SUPPORT FOR A SEATING DEVICE

(75) Inventors: Jerome J Congleton, College Station, TX (US); Mark E Benden, College Station, TX (US); Rebecca Congleton Boenigk, College Station, TX (US); John C Guillen, Snook, TX (US)

(73) Assignee: Neutral Posture, Inc., Bryan, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/043,381

(22) Filed: Jan. 26, 2005

(65) Prior Publication Data

US 2005/0127733 A1 Jun. 16, 2005

Related U.S. Application Data

(63) Continuation of application No. 10/313,407, filed on Dec. 6, 2002, now Pat. No. 6,877,812.

(51) Int. Cl.
*A47C 7/40* (2006.01)
*B60N 2/02* (2006.01)

(52) U.S. Cl. ..... 297/353; 297/383

(58) Field of Classification Search ..... 297/353, 297/383, 94, 423.13, 488; 248/118, 118.3, 248/118.5, 442.2, 289.11, 407

See application file for complete search history.

(56) References Cited

U.S. PATENT DOCUMENTS

| | | | | |
|---|---|---|---|---|
| 3,905,642 | A | 9/1975 | Simjian | 297/185 |
| 4,444,430 | A | 4/1984 | Yoshida et al. | 297/284 |
| 4,470,629 | A | 9/1984 | Collins, Jr. | 297/64 |
| 4,514,010 | A | 4/1985 | Gonzalez | 297/284 |
| 4,518,200 | A | 5/1985 | Armstrong | 297/284 |
| 4,557,520 | A | 12/1985 | Simjian | 297/185 |
| 4,655,503 | A | 4/1987 | Kamijo et al. | 297/238 |
| 4,807,931 | A | 2/1989 | Ishida et al. | 297/284 |
| 4,832,407 | A | 5/1989 | Serber | 297/423.12 |
| 4,938,528 | A | 7/1990 | Scott | 297/284 |
| 5,288,130 | A | 2/1994 | Foster | 297/411.36 |

(Continued)

FOREIGN PATENT DOCUMENTS

DE 3115269 A1 10/1982

OTHER PUBLICATIONS

Setting The Ergonomic Standard, Color Brochure, Neutral Posture Ergonomics, Inc., Apr. 1997.

Owner's Manual, Neutral Posture Ergonomics, Inc., Black and White Brochure, Feb. 1997.

"*Lean on Me*;" Medical and Ergonomic Products for the Healthcare and Business Professional, http://www.alimed.com/product_detail.cfm?VMID=2&FamilySKU=73251; Nov. 26, 2002.

"*About Alimed*;" Medical and Ergonomic Products for the Healthcare and Business Professional; http://www.ailmed.com/about.cfm; Nov. 26, 2002.

*Primary Examiner*—Anthony D. Barfield
(74) *Attorney, Agent, or Firm*—Howrey LLP

(57) ABSTRACT

A support apparatus is described for use in the field of workstation design. The support apparatus is movably attachable to a seating device to selectively provide both dorsal and ventral support to a seated user. The support apparatus is movable, by a user in the seated position, between the position providing ventral support and the position providing dorsal support. Also described is a method of selectively supporting either the ventral or dorsal side of a user by one apparatus, the apparatus moveable by a user in the seated position.

37 Claims, 15 Drawing Sheets

U.S. PATENT DOCUMENTS 5,562,324 A 10/1996 Massara et al. ..... 297/284.6
5,660,438 A 8/1997 Tedesco ..... 297/284
5,711,575 A 1/1998 Hand et al. ..... 297/284.6
5,758,925 A 6/1998 Schrewe et al. ..... 297/284
6,105,183 A 8/2000 Bly ..... 4/579
6,220,663 B1 4/2001 Benden et al. ..... 297/284.6
6,290,295 B1 9/2001 Benden et al. ..... 297/284.6
2004/0108763 A1 6/2004 Congleton et al. ..... 297/353

SUPPORT FOR A SEATING DEVICE

CROSS REFERENCE TO RELATED APPLICATIONS

This application is a continuation of U.S. patent application Ser. No. 10/313,407, filed Dec. 6, 2002, entitled "Support for a Seating Device," by Jerome J. Congleton, Mark E. Benden, Rebecca Congleton Boenigk, and John C. Guillen, hereby incorporated by reference in its entirety, now U.S. Pat. No. 6,877,812, issued Apr. 12, 2005.

BACKGROUND OF THE INVENTION

1. Field of the Invention

The invention relates to a support apparatus for a seating device. More particularly, this invention relates to a support apparatus for selectively providing both dorsal and ventral support to a user seated in a seating device, such as a chair or stool, for example. The support may be selectively moved from the dorsal-supporting position to the ventral-supporting position by a user while in the seated position. Additionally, when the support apparatus is in the ventral-supporting position, the user is not required to straddle any portion of the support apparatus.

2. Description of the Related Art

In the workplace, persons are often required to perform repetitive manual tasks in a sedentary position. By maintaining a sedentary position throughout the workday, the person can become fatigued without proper support. By utilizing ergonomic principles when designing furniture, worker productivity is increased, worker fatigue and absenteeism are decreased, and blood flow throughout the body is improved.

In many applications, it is desirable to properly support the upper torso of a person seated in a seating device, such as a chair or stool for example, throughout the day. In some instances, it may be desirable to provide a support for a user's back such that the user may lean back against the support apparatus. Thus, it is desirable in some instances for a support to provide dorsal support for a user. Dorsal support is support for the back of the user's upper torso.

In other circumstances, it is desirable to provide ventral support for a user. Ventral support is support for the front side of the user's upper torso. For instance, some operations at workstations within certain industrial settings, require a user to lean forward or repeatedly reach forward. Over time, the user may become fatigued while remaining in this forward-leaning position. Thus, it desirable in some situations to provide ventral support for a worker or user.

It is known to provide back supports for a user sitting in a chair. For instance, the background section of U.S. Pat. No. 6,220,663 to Benden et al., assigned to Neutral Posture Ergonomics, Inc. (incorporated herein by reference in its entirety) describes prior art chairs and patents directed to providing support for the back of a user, including lumbar support, while seated in the chair. However, these traditional backrests provide only dorsal support, and are generally not suitable for providing ventral support of a user.

It is also known to provide ventral support for a user. For instance, a ventral rest may be provided on the workstation, not the chair. A user in the chair may then lean against the ventral rest on the workstation while leaning forward. However, this requires two separate pieces of equipment (the chair and the rest on the workstation) which can be problematic in a busy manufacturing floor, for example, as a user on one shift may desire ventral support while the user of the next shift at the same station may desire dorsal support. As these ventral supports on the workstations are not adjustable, other means for providing dorsal support would be required.

It is also known to have a rest that may provide both ventral and dorsal support. With these devices, the rest is simply placed on the floor or workstation and the user leans against the rest while standing. However, these ventral-support devices having this dual capability are "stand and lean" devices. As these devices are designed for standing users, each is limited to the specific height of the present user. When a user of a different height replaces the current user, such as after changing shifts, another stand and lean device must be used for the new user.

Finally, it is known to have a rest that has two brackets to mount the rest to the chair: one on the front of the chair (for ventral support) and one on the rear of the chair (for dorsal support). With these devices, the rest may be mounted to the first bracket to provide ventral support. To change the configuration, the user must get out of the chair, remove the rest, and insert the rest into the second bracket. Again, this configuration requires two separate pieces of equipment, which may lead to the rest becoming misplaced.

Further, when the rest is in the position to provide ventral support, the user must mount the chair from the back, with his or her legs straddling the bracket. This straddling is undesirable to users in various workplace situations.

For the foregoing reasons, there is a need for a single, versatile support apparatus which can be used to selectively provide both dorsal and ventral support for a user. It is desirable that the apparatus be easily converted from traditional dorsal support of the upper body to ventral support of the upper body. It is desirable that the support apparatus be operable without the user having to straddle any portion of the apparatus. It is also desirable that the support apparatus be adjustable from a dorsal-supporting position to ventral-supporting position, by a user while remaining in a seated position. Finally, it is desirable that the apparatus be comprised of generally one piece of equipment, attachable to the seating device, so that the two do not become separated.

SUMMARY OF THE INVENTION

A support apparatus is described for use by a user seated on a seating device, having a support movably mountable to the seating device such that when the support is in a first position, the support is adapted to provide ventral support for the user and when the support is in a second position, the support is adapted to provide dorsal support for the user, wherein the support is selectively movable from the first to the second position by the user while in the seated position. The apparatus may comprise a pivot arm that is rotatably attachable to the seating device.

In some aspects, the pivot arm may have a first substantially horizontal member rotatably mountable to the seating device and a riser connected to the first substantially horizontal member, the support adapted to being attachable to the riser. The pivot arm may further comprise a second substantially horizontal member adapted to moveably attach the support to the riser.

In some embodiments, the support is movably attached to the second substantially horizontal member by a first attachment means. The support may comprise a cushion. Each of the components of the pivot arm may have an adjustable length.

Also described is a method of supporting a user seated in a seating device, the method comprising (1) providing a support apparatus having a support movably mountable to the seating device such that when the support is in a first position, the support is adapted to provide ventral support for the user and when the support is in a second position, the support is adapted to provide dorsal support for the user, a first substantially horizontal member rotatably mountable to the seating device, a riser connected to the first substantially horizontal member, the support adapted to being attachable to the riser, and a second substantially horizontal member adapted to movably attach the support to the riser; (2) rotating the support apparatus such that the support is at the front of the chair so that the user can lean forward on the support, the support thus providing ventral support; and (3) rotating the support apparatus such that the support is at a rear of the seating device such that the user can lean backward on the support, the support thus providing dorsal support, wherein the support apparatus may be rotated by the user remaining in a seated position.

The method may further comprise changing a height of the support apparatus by removing a bolt in a first hole in the riser and inserting the bolt into a second hole in the riser to attach the riser to the first substantially horizontal member.

Figure 1:
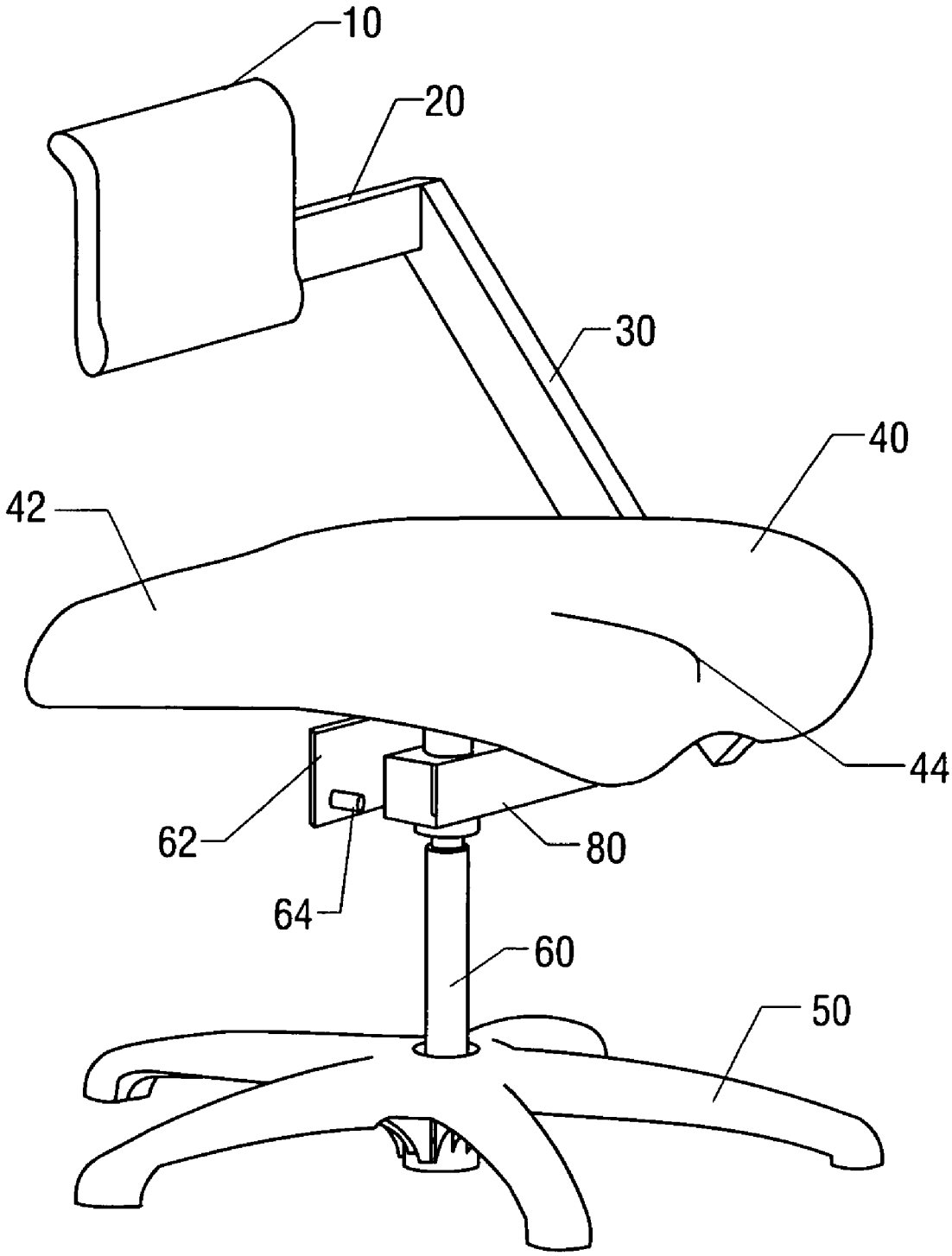
FIG. 1 right perspective view of one embodiment of the present invention.

While the invention is susceptible to various modifications and alternative forms, specific embodiments have been shown by way of example in the drawings and will be described in detail herein. However, it should be understood that the invention is not intended to be limited to the particular forms disclosed. Rather, the intention is to cover all modifications, equivalents and alternatives falling within the spirit and scope of the invention as defined by the appended claims.

DESCRIPTION OF ILLUSTRATIVE EMBODIMENTS

The invention relates to an apparatus and a method to provide either dorsal or ventral support to a user while seated in a seating device. The same support may be rotated from a position providing dorsal support to a position providing ventral support by the user in a seated position. The same support is easily movable from a position that provides dorsal support to a position that provides ventral support. This movement may be performed by a user while seated. Further, the support does not have to be removed from the seating device during this movement. Finally, when the support is in the position to provide ventral support, the user does not have to straddle a component of the support.

Illustrative embodiments of the invention are described below as they might be employed in providing ventral and dorsal support for a user seated on a seating device, such as a chair or stool. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of the this disclosure.

Further aspects and advantages of the various embodiments of the invention will become apparent from consideration of the following description and drawings.

Referring to FIG. 1, one embodiment of the present invention is shown in combination with a seating device. In this embodiment, the seating device is shown as a traditional industrial chair comprised of a seat 40 resting on a support column 60 support by chair legs 50. Seat 40 has a rear side 42 and a front side 44. Chair legs 50 are shown in a substantially horizontally extending legs. In operation a person (not pictured) sits in seat 40.

Although the seating device shown is a traditional, star-base industrial chair, the invention is not so limited. For instance, the seating device could comprise a stool, a four-legged chair, a bench, or any number of seating devices known to one of ordinary skill in the art having the benefit of this disclosure. Further, the seating device may further comprise armrests, footrests, casters, a lever to adjust the seat's height, an adjustment means to allow the seat to slide forward and backward on the column 60, ect.

Also shown in FIG. 1 is a support apparatus. In the configuration shown, support 10 may be used to provide dorsal support for the user (not shown) seated in the seating device as described hereinafter. In other words, the user may lean his or her back against support 10 while seated.

Support 10 is rotatably attachable to the seating device via a pivot arm. The pivot arm may comprise a first substantially horizontal member 80 which is rotatably attachable to the support column 60 of the seating device. The pivot arm may further comprise a riser 30 adapted to connect to the support. Further, the support 10 may be connected to the riser 30 by the second substantially horizontal member 20. The first substantially horizontal member 80, the riser 30, and the second substantially horizontal member 20 may be comprised of a metal tube, a metal bar, an integral rod, or any number of materials designed to perform the desired function as stated herein. In some embodiments, the support 10 may further comprise a cushion to provide comfort for the seated user.

Figure 12A:
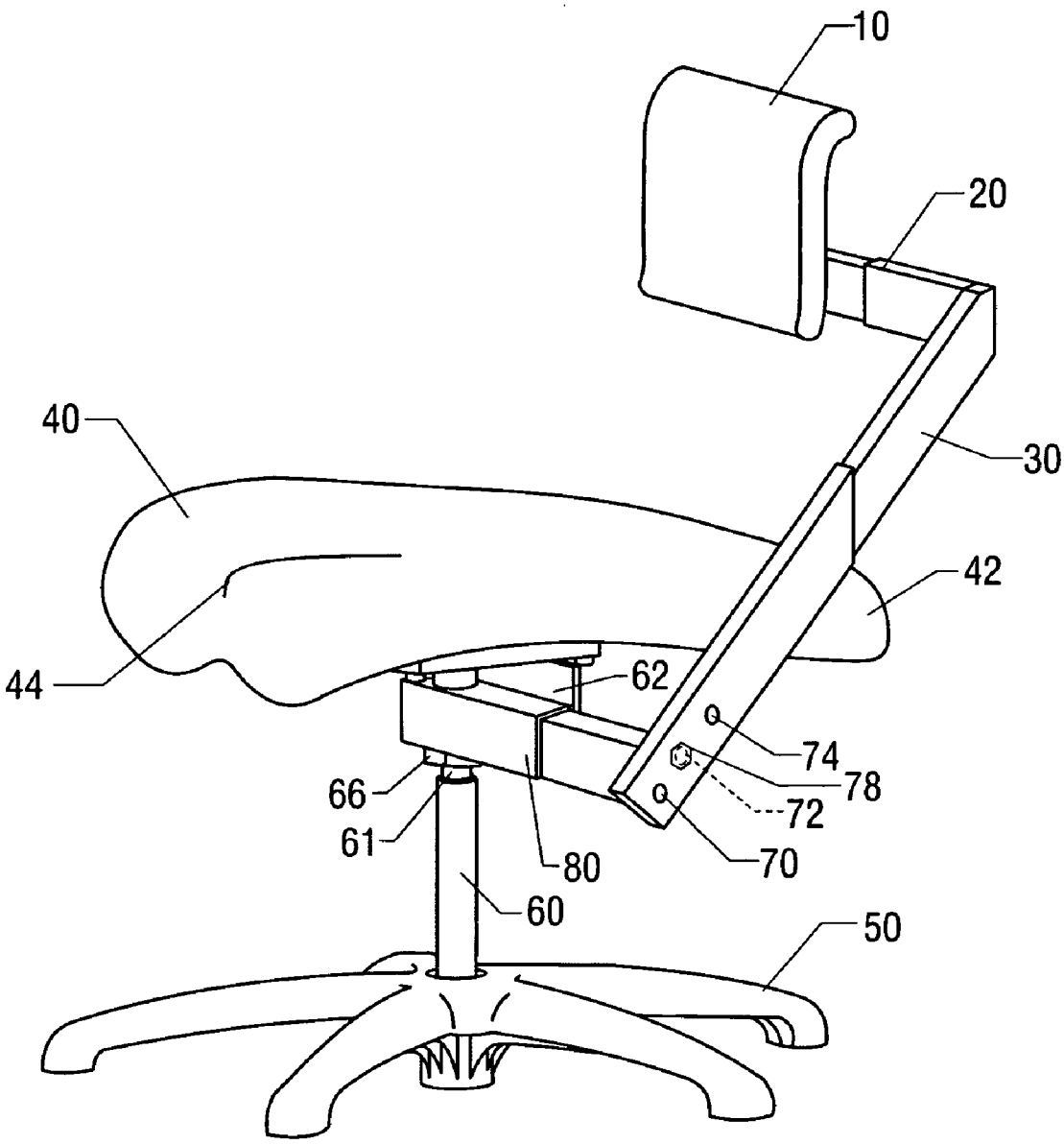
FIGS. 12A and 12B show embodiments of the present invention in which the pivot is comprised of members with adjustable lengths.
Figure 12B:
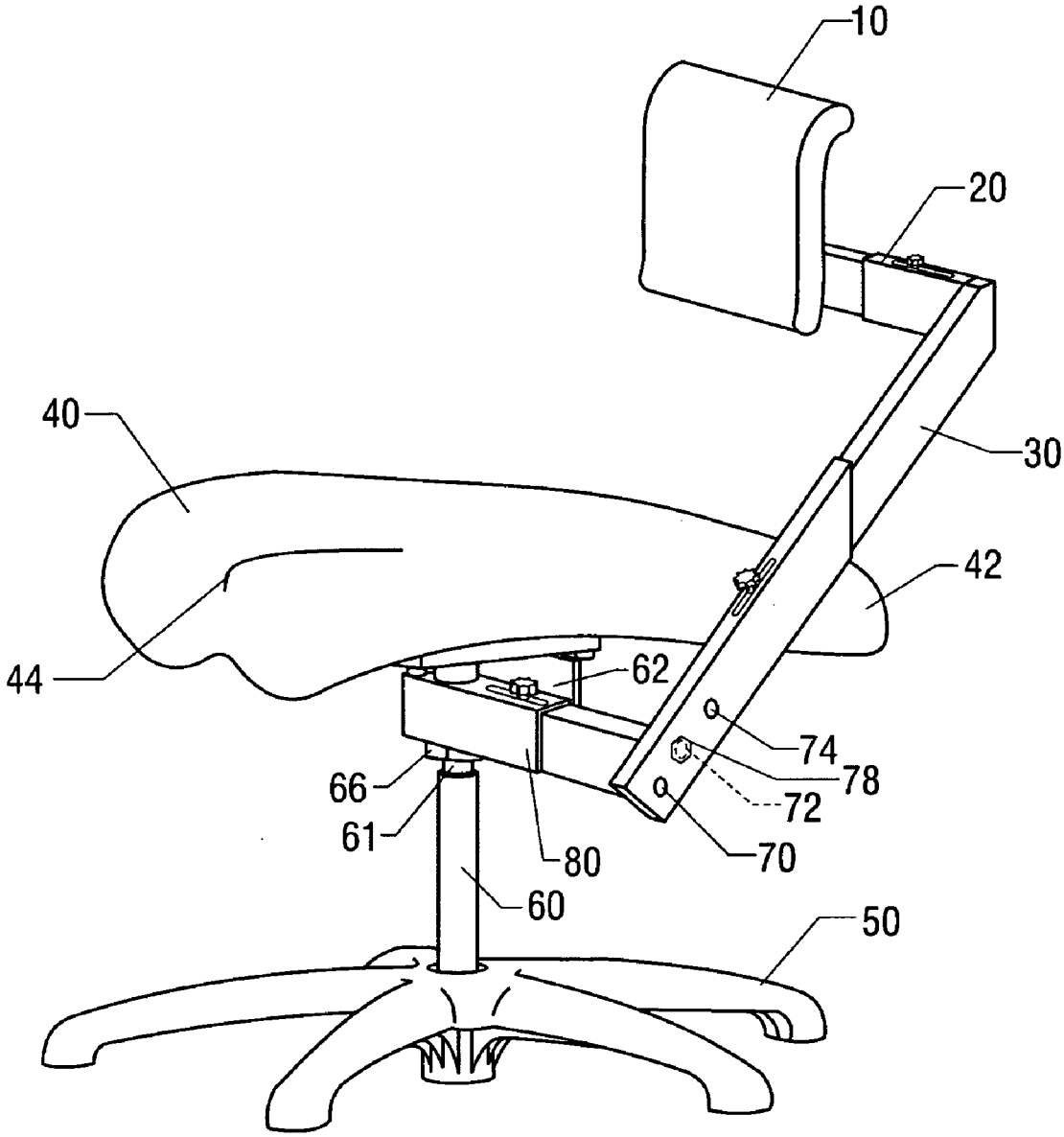

Further, although not shown in FIG. 1 but shown in FIGS. 12A and 12B, each of the pivot arm components (i.e., in this embodiment, the first substantially horizontal member 80, the riser 30, and/or the second substantially horizontal member 20) may have length that is adjustable to accommodate users of different sizes. For instance and as shown in FIG. 12A, a pivot arm component may be comprised of two pieces, which are telescopically mounted to each other. Or, as shown in FIG. 12B, a pivot arm component could be comprised of two pieces, one having a groove into which a knob mounted on the other piece could travel. By un-tightening the knob and sliding the knob within the groove of the first component, the overall length of the pivot arm component may be adjusted. Any number of means for adjusting the pivot arm component length, known to one of ordinary skill in the art, could be utilized.

Figure 2:
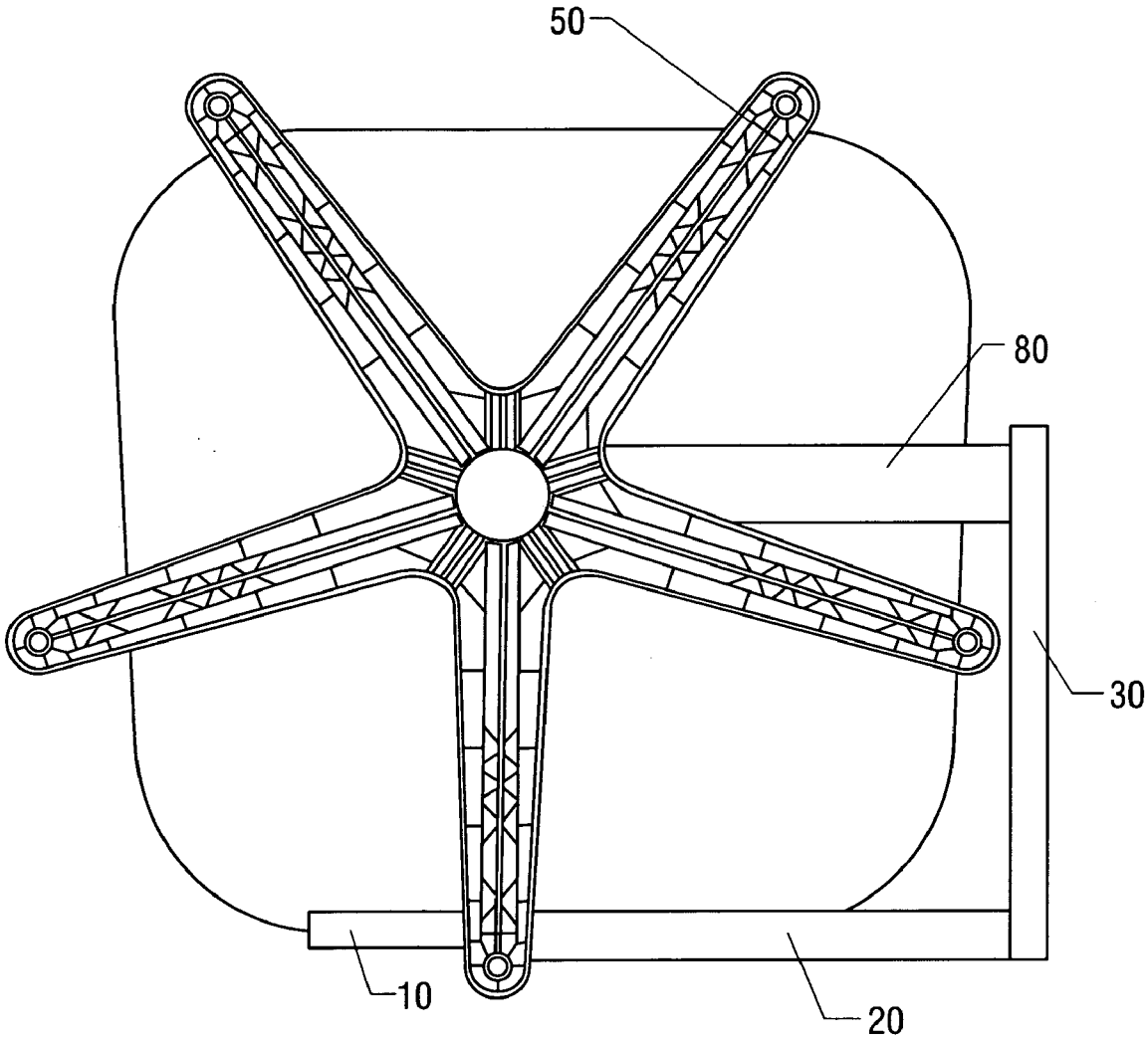
FIG. 2 shows a bottom view of one embodiment of the present invention.

FIG. 2 shows a bottom view of the embodiment of FIG. 1.

Figure 3:
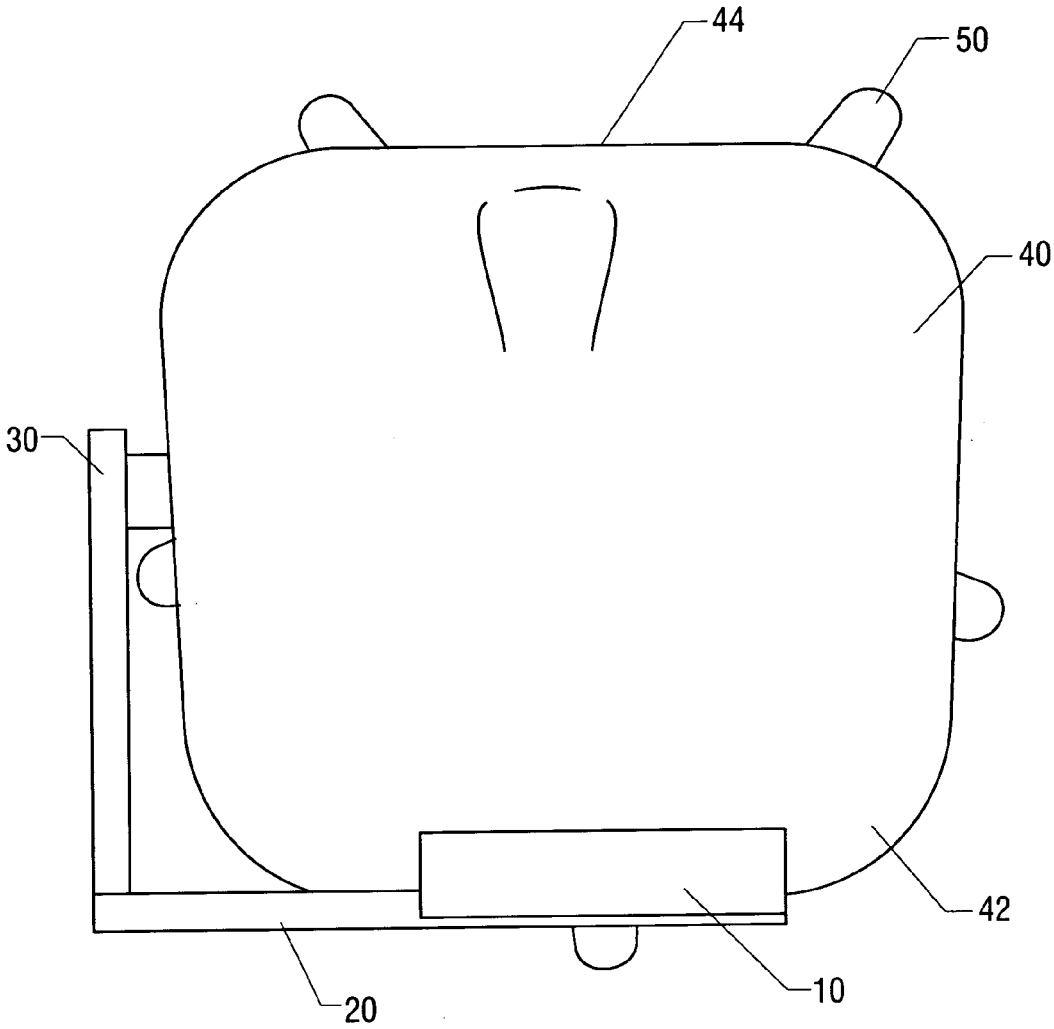
FIG. 3 shows a top view of one embodiment of the present invention with the support in a position to provide dorsal support.

The pivot arm may be rotatably mountable to the seating device to allow a seated user move the support 10 from one position that provides dorsal support to a position that provides ventral support. For example, FIG. 3 shows an embodiment of the present ivention in which the support 10 is in a position to provide dorsal support for a seated user. Note that the support 10 is more substantially aligned with the rear 42 of the seat 40, as opposed to the front 44 of the seat 40.

Figure 4:
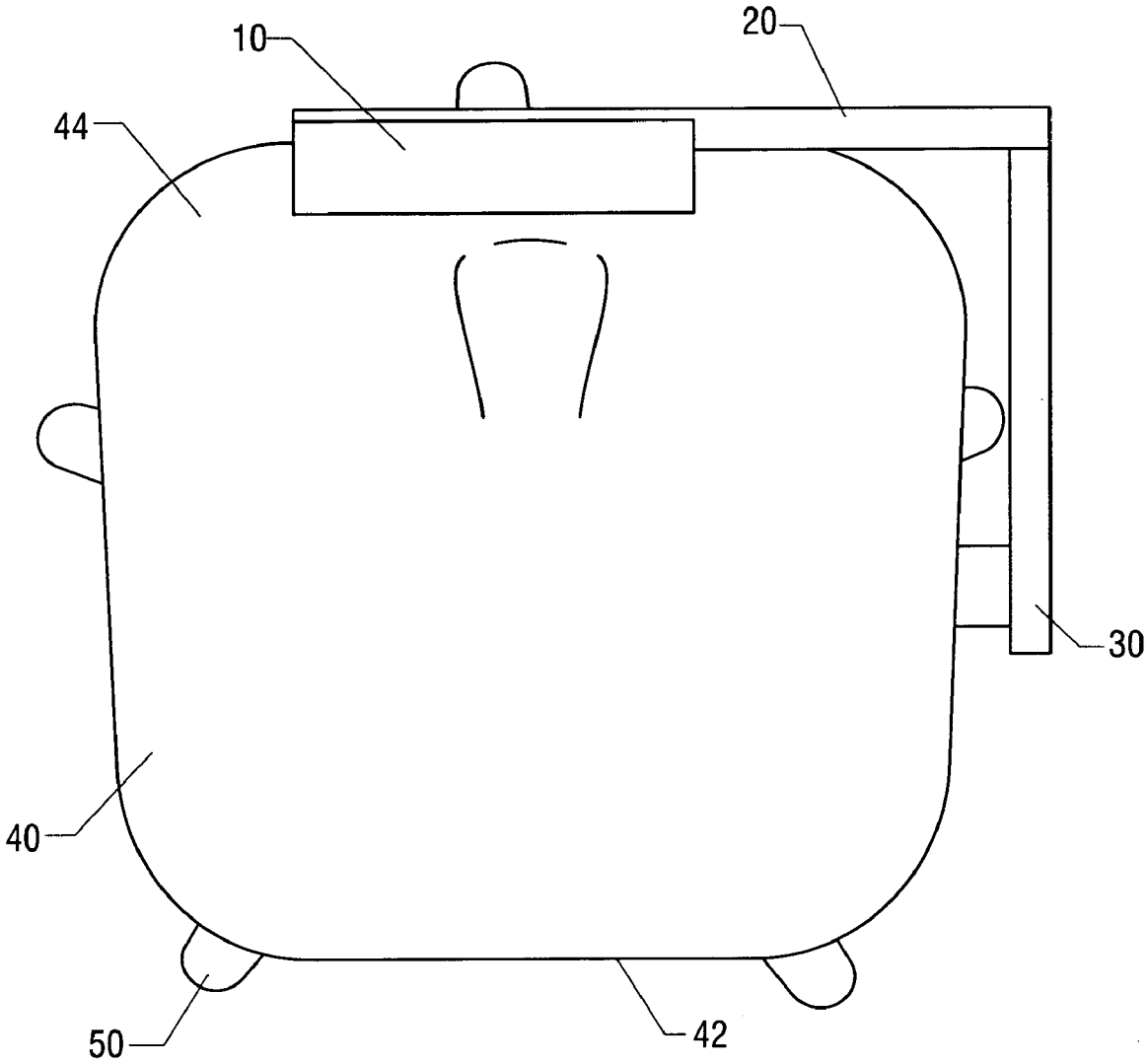
FIG. 4 shows a top view of one embodiment of the present invention with the support in a position to provide ventral support.

Conversely, FIG. 4 shows an embodiment of the present invention in which the support 10 is in a position to provide ventral support for a seated user. Note that the support 10 is more substantially aligned with the front 44 of the seat 40, as opposed to the rear 42 of the seat 40.

It should be noted that the two support positions shown in FIGS. 3 and 4 are not required to be 180 degrees apart. For instance, in this embodiment, the first position in which dorsal support is provided (FIG. 3) to the other position in which ventral support is provided (FIG. 4) are 180 degrees apart from each other. However, the invention is not so restricted. I.e., in some applications, the two positions may be 90 degrees (or any number of degrees) from each other.

In operation, a user may lean his or her back against support 10 when the support 10 is located in a first position as shown in FIG. 3. When it is desired to provide ventral support for the user (i.e. the user is leaning forward), the support 10 may be rotated to provide to another position as shown in FIG. 4. The user may then lean his or her chest or abdomen (or any other ventral surface) onto the support 10. Note that the support 10 is mountable onto the seating device such that a user is not required to straddle any part of the support apparatus.

Of course, the support apparatus may be rotated in reverse (i.e. from the ventral support position to the dorsal support position) as desired by the user. Also, as will be further detailed below, the rotation of the support 10 between the two positions, may be easily accomplished by a user in a seated position without removing the support from the seating device.

Figure 5:
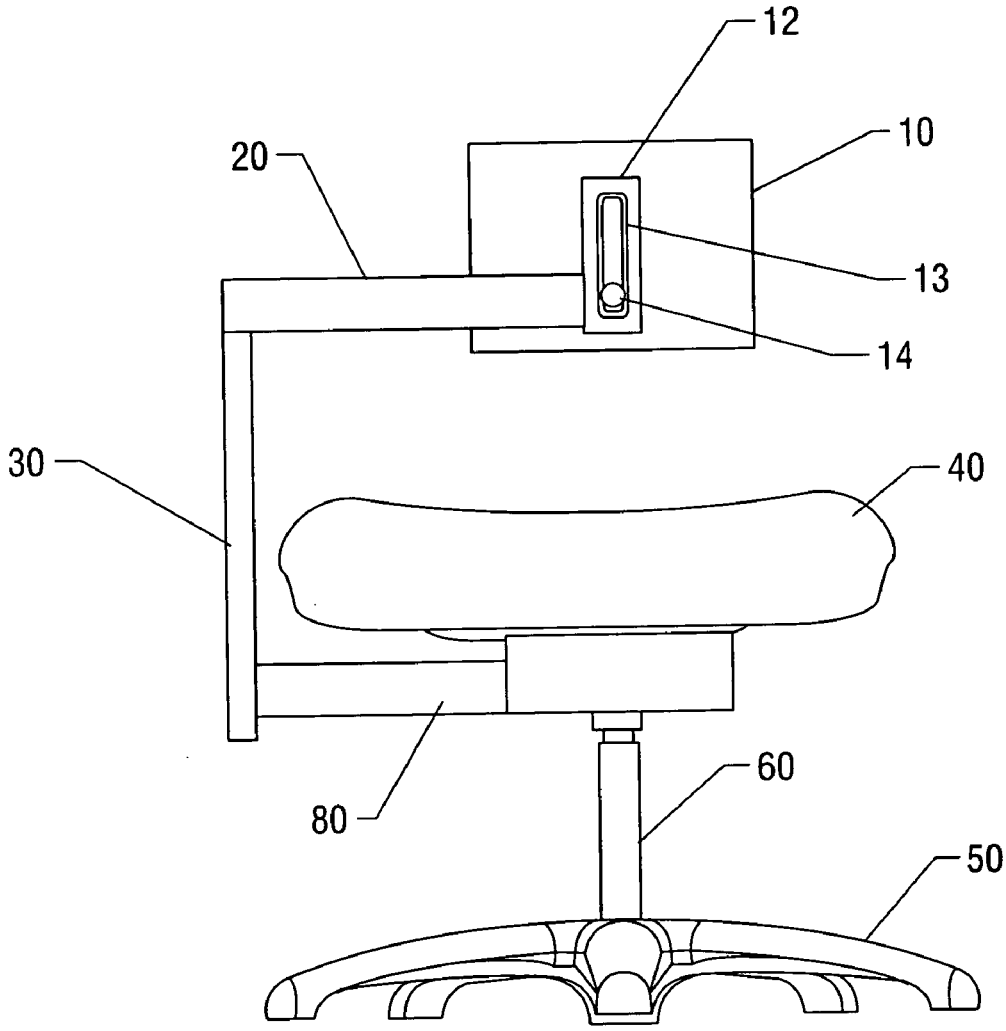
FIG. 5 shows an embodiment of the present invention having a first adjustment means on the support.

The support 10 may be adjustably attached to the pivot arm to adjust the support for users of different heights. For example, FIG. 5 shows a rear view of the support 10 being connected to the pivot arm via a first attachment means. In this embodiment, the support 10 is connected to the second substantially horizontal member by the first attachment means on the support 10 which comprises a knob 14 and a bracket 12 having a slot 13. The bracket 12 is attached to the back of support 10. To adjust the height of the support, the user un-tightens the knob 14 and raises or lowers the support 10 (a portion of the knob 14 sliding within slot 13). Once the desired height is reached, the user may tighten the knob 14.

Again, any number of attachment means, such as telescopically connected members, a ratcheting height adjustment, a small tube fitting inside a large tube each having a row of holes which may be aligned with via push-pin to adjust the height, ect. could be utilized for the first attachment means.

Figure 6A:
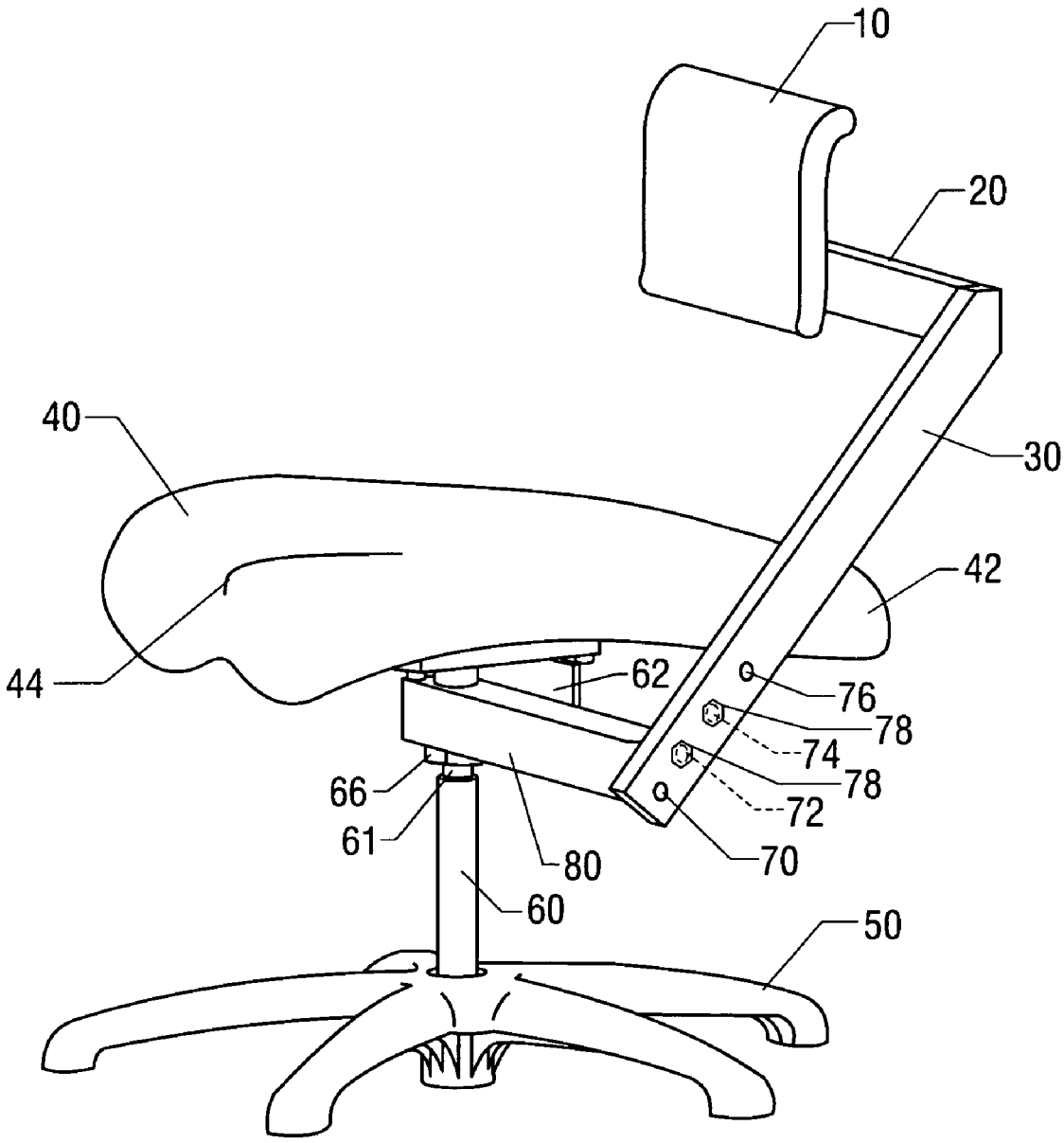
FIG. 6A shows a left perspective view of one embodiment of the present invention.
Figure 6B:
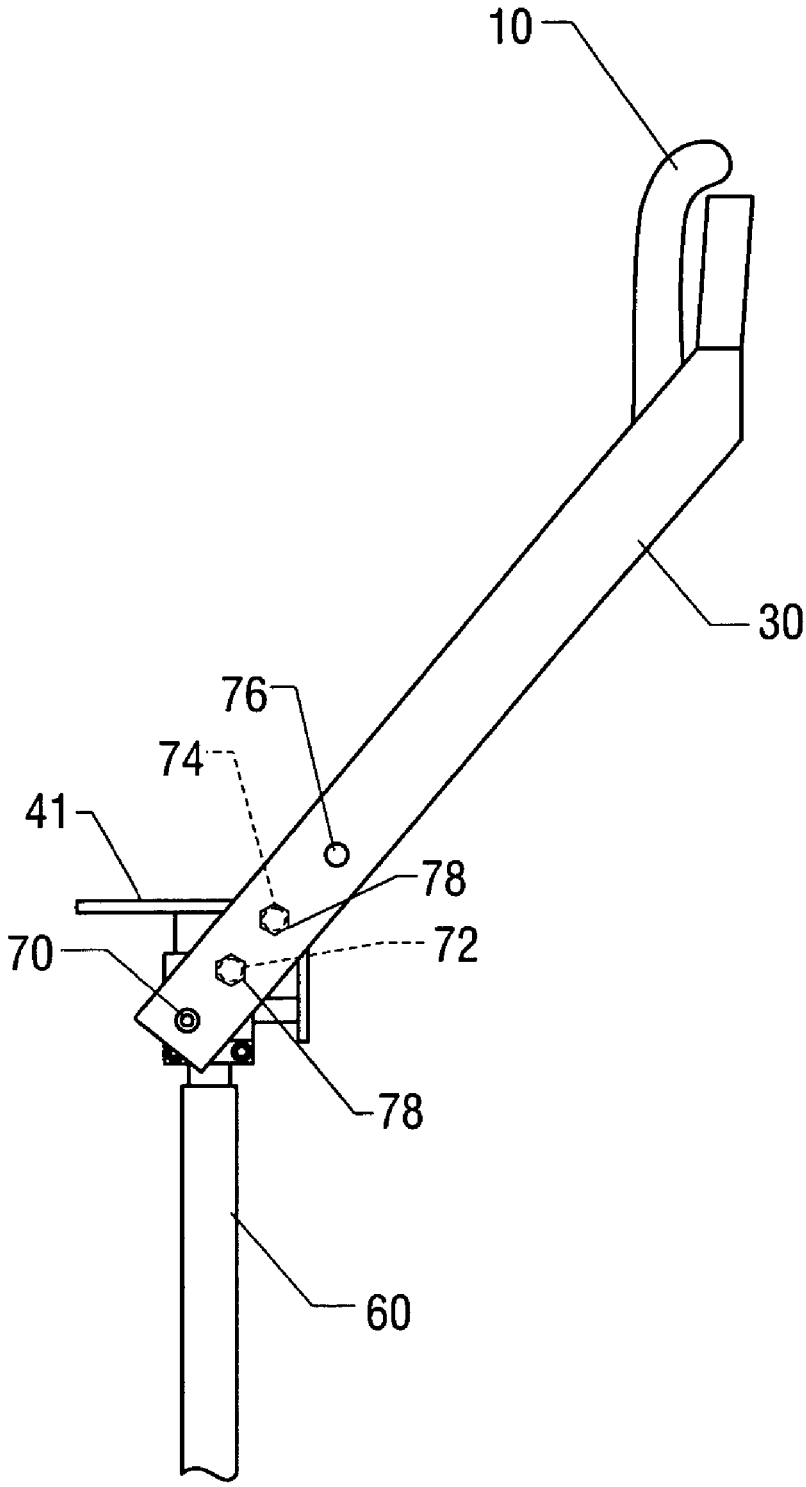
FIG. 6B shows an embodiment of the present invention having a second adjustment means on a riser bar of one embodiment of the present invention.

In some embodiments of the present invention, the height of the support 10 is adjustable via a second attachment means on the riser 30. For instance, by way of example and as shown in FIGS. 6A and 6B, one end of rise 30 further comprises a plurality of holes. In this embodiment, the plurality of holes comprises a first hole 70, a second hole 72, a third hole 74, and a fourth hole 76. Two bolts (or spring-loaded push pins) 78 may be inserted into any two adjacent holes to attach the riser 30 (an thus support 10) to the first substantially horizontal member 80. For instance, if bolts (or spring loaded push pins) 78 are in holes 72 and 74 and the user desires to raise the support 10, the bolts 78 may be removed and inserted into holes 70 and 72 and tightened to connect the riser 30 to the first substantially horizontal member 80. Alternatively, to lower the support 10, the bolts (or spring loaded push pins) 78 may be removed from hole 70 and 72 and inserted into holes 72 and 74, or 74 and 76. Also, by placing holes 70, 72, 74, and 76 in a line forming different angles, the angle of support 10 may also be adjusted.

Again, any number of attachment means, such as telescopically connected members, a ratcheting height adjustment, a small tube fitting inside a large tube each having a row of holes which may be aligned with via push-pin to adjust the height, etc. could be utilized for the second attachment means. For instance, the riser 30 may have a slot and a cam lock such that the when the cam lock was unlocked, the riser 30 is free to move along the slot with respect to the seating device, and when the cam lock is locked, the riser 30 is no longer free to move. Or, the riser could further comprise an air cylinder that allows riser 30 to raise or lower as desired.

Figure 7A:
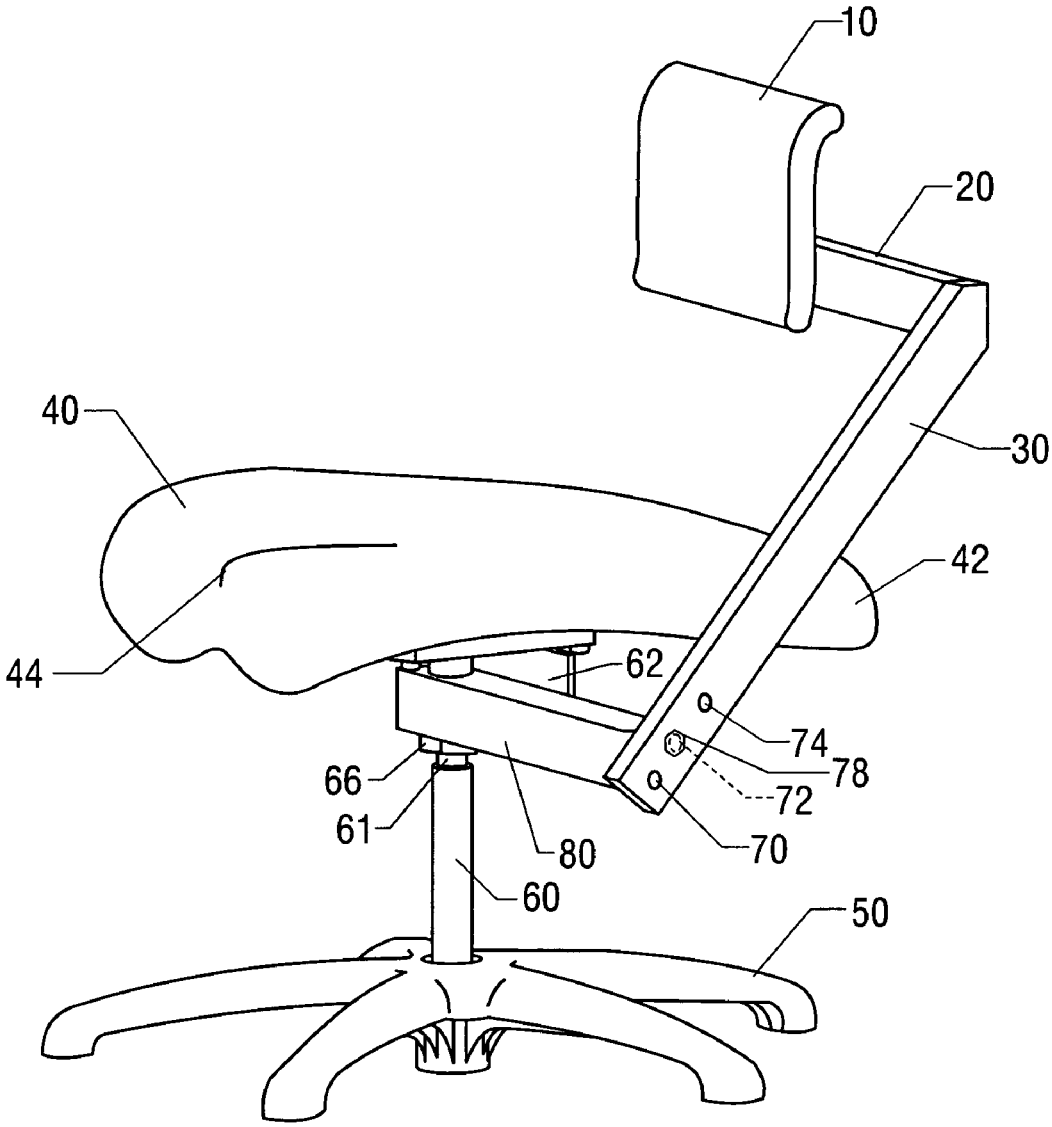
FIG. 7A shows a left perspective view of one embodiment of the present invention.
Figure 7B:
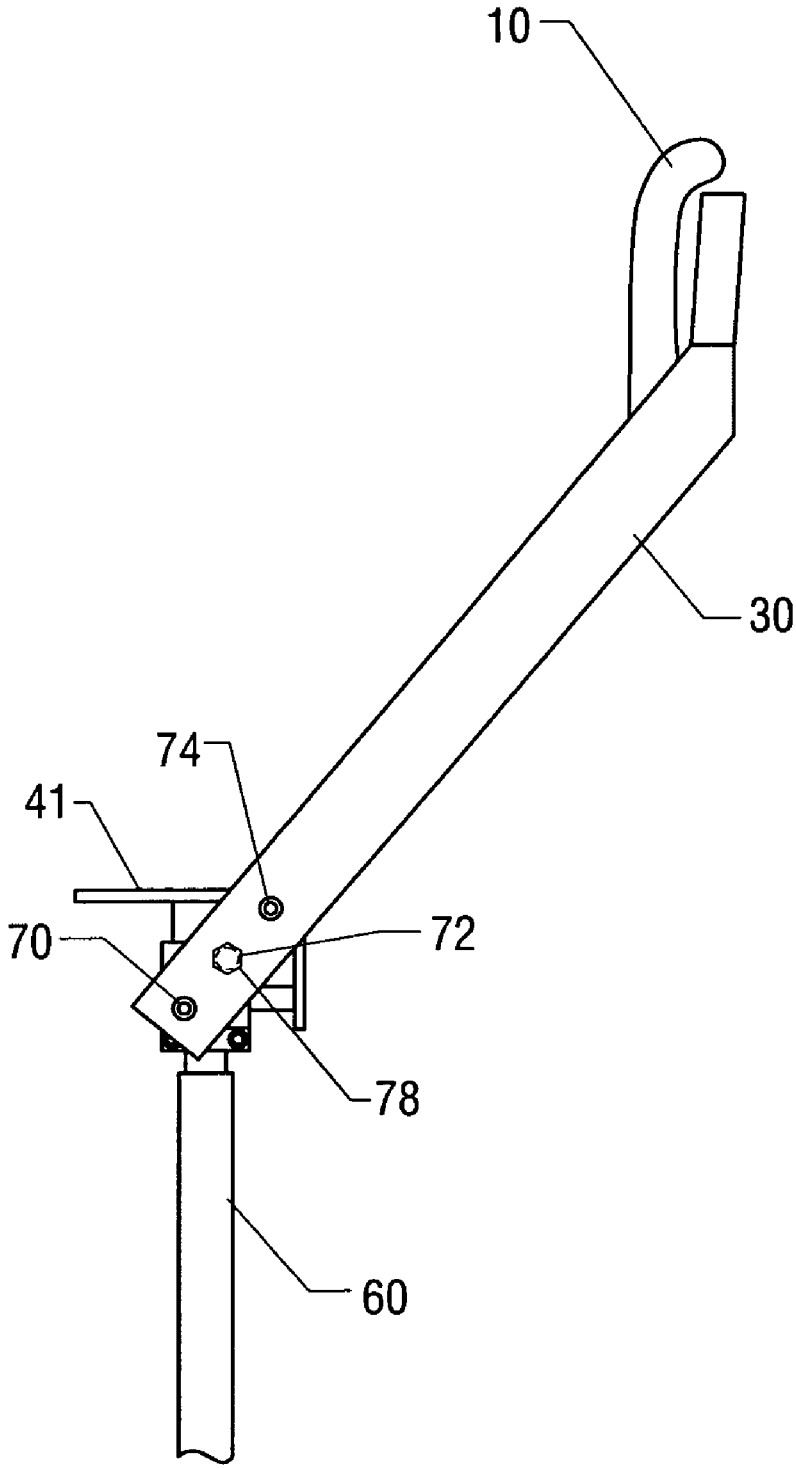
FIG. 7B shows an embodiment of the present invention having a second adjustment means on a riser bar of one embodiment of the present invention.

In the embodiment shown in FIGS. 6A and 6B, four holes 70, 72, 74, and 76 are utilized in conjunction with two bolts 78 such that three predetermined positions corresponding to given heights are available. However, the invention is not so limited. For instance, FIGS. 7A and 7B shows an embodiment that utilizes only one bolt 78 that may be inserted into only one hole 70, 72, or 74. Any number of holes and bolts may be used. In short, any number of adjustment means known to one of ordinary skill in the art having benefit of this disclosure may be utilized.

Figure 8:
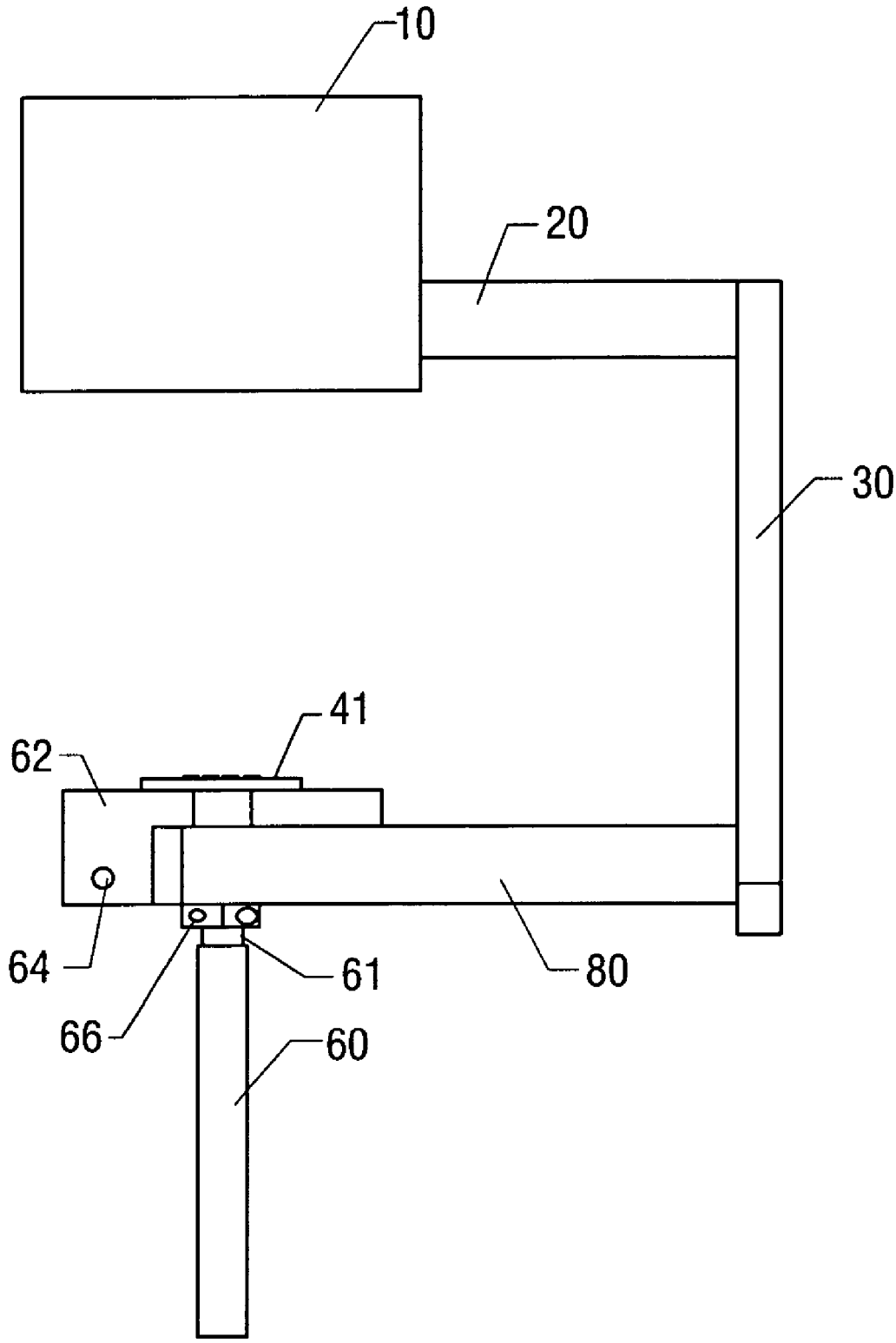
FIG. 8 shows an embodiment of the present invention, the seat being removed from the seating device.

FIG. 8 shows an embodiment of the present invention having collar 66. Collar 66 is adjustably mountable on the upper portion 61 of column 60 of the seating device. Collar 66 supports the pivot arm vertically such that the pivot arm may rotate freely. Further, when the seat of the chair is in its lower-most position, collar 66 contacts the lower portion of column 60 while allowing the pivot arm to rotate as desired.

Figure 9:
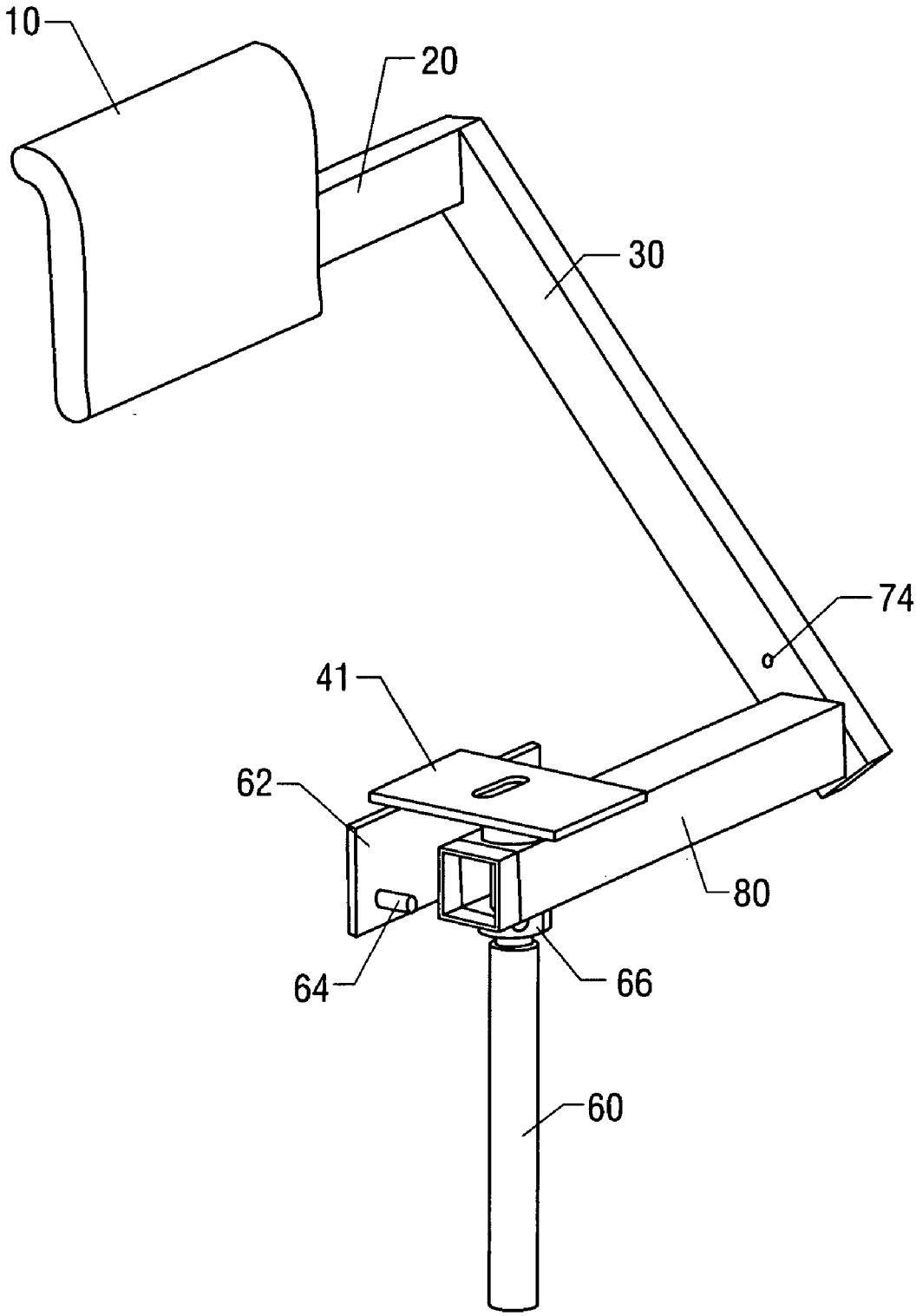
FIG. 9 shows one embodiment of the present invention having a stop mountable to the seating device.
Figure 10:
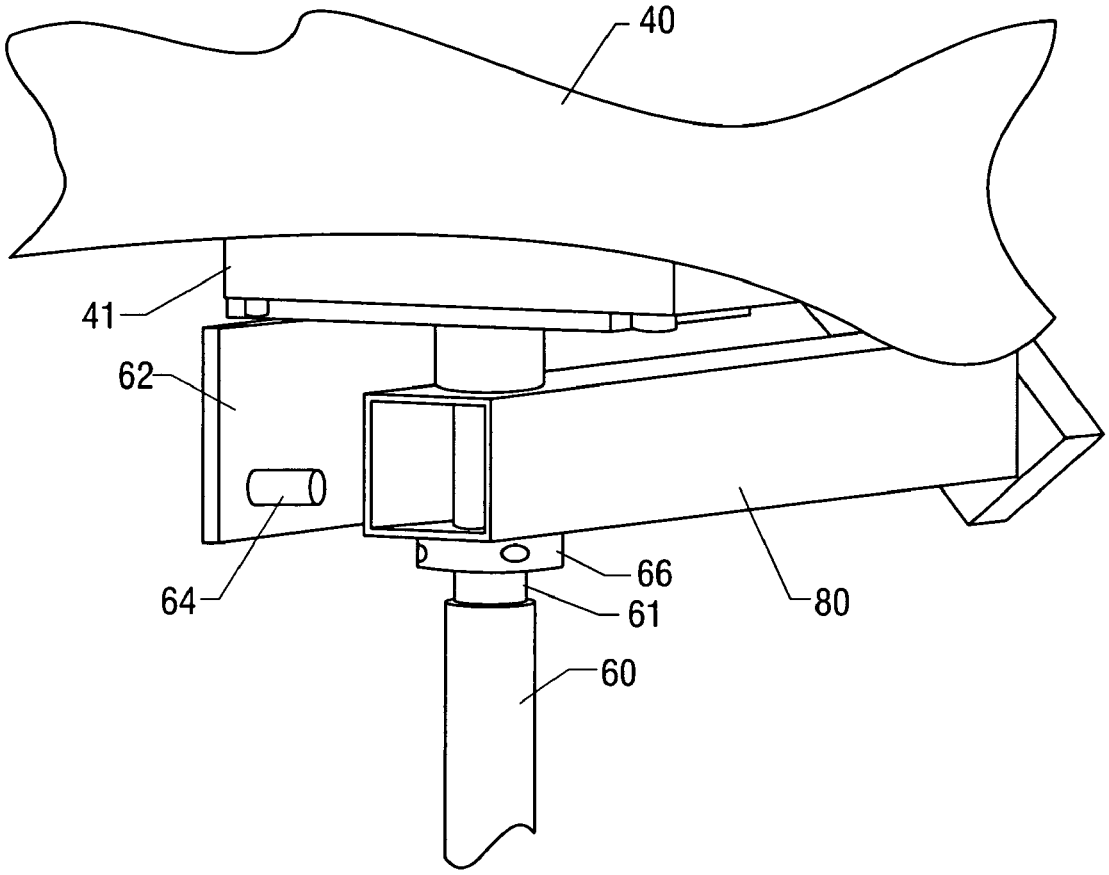
FIG. 10 shows a close up view of a collar, stop, and pin of one embodiment of the present invention.
Figure 11:
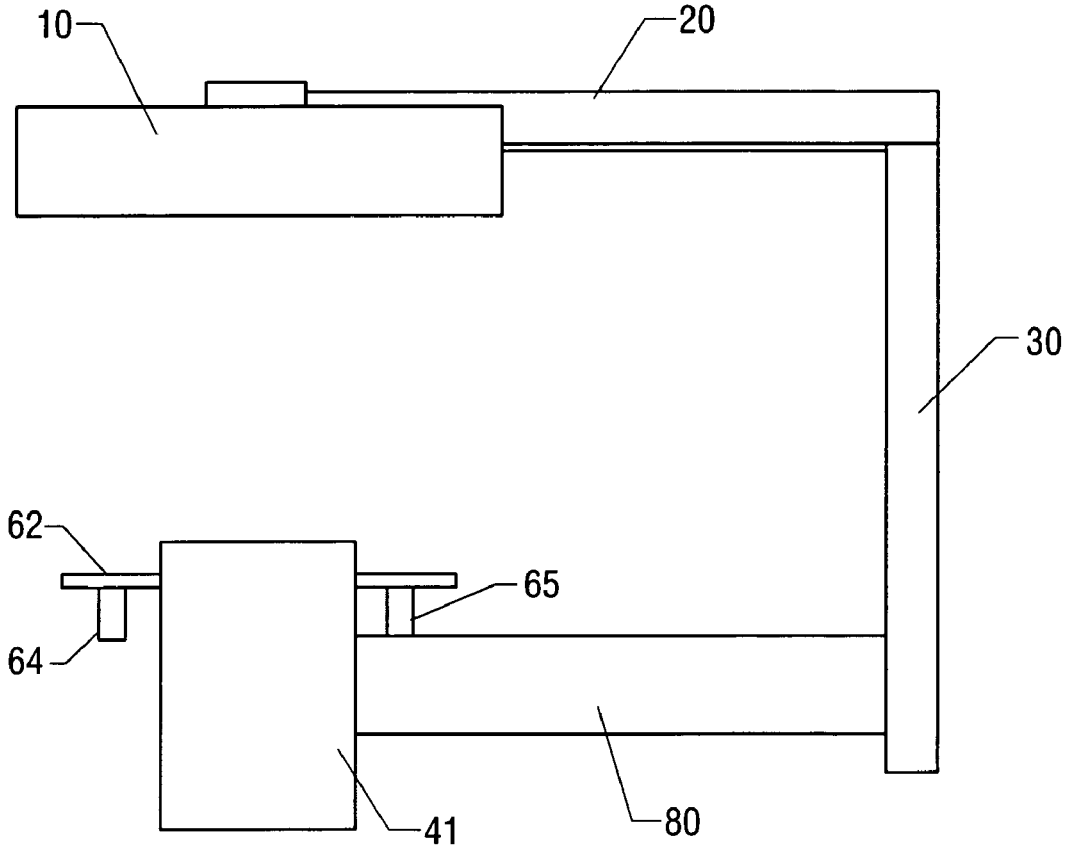
FIG. 11 shows components of one embodiment of the present invention is isolation.

Also shown in FIG. 8, as well as FIGS. 9–11, is an embodiment of the present invention further comprising a stop 62. In these figures, the seat 40 has been removed exposing seat base 41. The stop 62 is mountable to the seat 40 via seat base 41 such that the stop 62 does not rotate with the pivot arm. Stop 62 may comprise pins 64 and 65.

In operation, the first substantially horizontal member 80 contacts the stop 62 via pin 65 when the support 10 is in a position to provide dorsal support, as shown in FIG. 11. In this position, the stop 62 prohibits the pivot arm from rotating in a counterclockwise direction with respect to the seat base 41. When the user desires ventral support, the user may rotate the pivot arm clockwise until the pivot (and here, until the first substantially horizontal member 80) contacts pin 64 on stop 62.

In the embodiment shown, the stop 62 is flat. Thus, the two positions (i.e. the first in which the support provides dorsal support and the second where the support provides ventral support) are necessarily 180 degrees apart. However, by bending the stop 62 at a given angle, e.g. 90 degrees, the stop 62 would allow the two positions to be 90 degrees apart.

Although various embodiments have been shown and described, the invention is not so limited and will be understood to include all such modifications and variations as would be apparent to one skilled in the art.

What is claimed is:

1. An apparatus for use by a user seated on a seating device, the apparatus comprising:

a support movably associated with the seating device such that when the support is in a first position, the support is adapted to provide ventral support for the user as the user leans forwardly against the support, and when the support is in a second position, the support is adapted to provide dorsal support for the user as the user leans back against the support, wherein the support is selectively movable from the first to the second position by the user while in the seated position, the support being attachable to a pivot arm that is rotatably attachable to the seating device, the pivot arm having:

a first substantially horizontal member rotatably mountable to the seating device; and a riser connected to the first substantially horizontal member, the support adapted to be movably attachable to the riser to accommodate different users, the riser having a second attachment means for connecting the riser to the first substantially horizontal member, the second attachment means adapted for selectively adjusting the support to a predetermined height.

2. The apparatus of claim 1 in which the second attachment means comprises a bolt and a plurality of holes within the riser, the bolt placed within one of the plurality of holes to attach the riser to the first substantially horizontal member.

3. An apparatus for use by a user seated on a seating device, the apparatus comprising:

a support movably associated with the seating device such that when the support is in a first position, the support is adapted to provide ventral support for the user as the user leans forwardly against the support, and when the support is in a second position, the support is adapted to provide dorsal support for the user as the user leans back against the support, wherein the support is selectively movable from the first to the second position by the user while in the seated position, the support being attachable to a pivot arm that is rotatably attachable to the seating device, the pivot arm having:

a first substantially horizontal member rotatably mountable to the seating device, the first substantially horizontal member having an adjustable length; and a riser connected to the first substantially horizontal member, the support adapted to be movably attachable to the riser to accommodate different users.

4. An apparatus for use by a user seated on a seating device, the apparatus comprising:

a support movably associated with the seating device such that when the support is in a first position, the support is adapted to provide ventral support for the user as the user leans forwardly against the support, and when the support is in a second position, the support is adapted to provide dorsal support for the user as the user leans back against the support, wherein the support is selectively movable from the first to the second position by the user while in the seated position, the support being attachable to a pivot arm that is rotatably attachable to the seating device, the pivot arm having:

a first substantially horizontal member rotatably mountable to the seating device; and a riser connected to the first substantially horizontal member, the riser having an adjustable length, the support adapted to be movably attachable to the riser to accommodate different users.

5. The apparatus of claim 4 in which the pivot arm further comprises a second substantially horizontal member adapted to movably attach the support to the riser.

6. The apparatus of claim 5 in which the support is attachable to the pivot arm such that the support is selectively adjustable to a predetermined height.

7. The apparatus of claim 6 in which the support is movably attached to the second substantially horizontal member by a first attachment means.

8. The apparatus of claim 5 in which the support further comprises a cushion.

9. The apparatus of claim 5 further comprising a stop adapted to allow the support to be rotatable 180 degrees, the stop having a first pin adapted to contact the first substantially horizontal member when the support is in die first position; and a second pin adapted to contact the first substantially horizontal member when the support is in the second position.

10. The apparatus of claim 9 further comprising a collar attachable to the seating device, the collar adapted to allow the first substantially horizontal member to rotate, the collar selectively maintaining the support a predetermined height.

11. The apparatus of claim 5 in which the support is movably attached to the second substantially horizontal member by a first attachment means.

12. The apparatus of claim 3 wherein the riser; and the second substantially horizontal member comprises a metal tube; a metal bar, or an integral rod.

13. The support apparatus of claim 4 in which the pivot arm is composed of two pieces telescopically mounted to each other.

14. The support apparatus of claim 4 or 5 in which the riser is comprised of two pieces telescopically mounted to each other.

15. The support apparatus of claim 14, in which the riser comprises a first and a second piece being connectable by a knob passing through a groove in one piece, the length of the riser thereby being adjustable to accommodate different users.

16. An apparatus for use by a user seated on a seating device, the apparatus comprising:

a support movably associated with the seating device such that when the support is in a first position, the support is adapted to provide ventral support for the user as the user leans forwardly against the support, and when the support is in a second position, the support is adapted to provide dorsal support for the user as the user leans back against the support, wherein the support is selectively movable from the first to the second position by the user while in the seated position, the support being attachable to a pivot arm that is rotatably attachable to the seating device, the pivot arm having:

a first substantially horizontal member rotatably mountable to the seating device, the first substantially horizontal member having an adjustable length; and a riser connected to the first substantially horizontal member, the support adapted to be movably attachable to the riser to accommodate different users; and a second substantially horizontal member adapted to movably attach the support to the riser, in which the second substantially horizontal member has an adjustable length.

17. A support apparatus for use by a user seated on a seating device, the support apparatus comprising:

a pivot arm being rotatably attachable to the seating device, the pivot arm further comprising a riser between a first substantially horizontal member and a second substantially horizontal member; and a support attachable to the pivot arm and moveably functionally associated with the seating device such that when the support is in a first position, the support is adapted to provide ventral support for the user as the user leans forwardly to contact the support, and when the support is in a second position, the support is adapted to provide dorsal support for the back of the user as the user leans back against the support.

wherein the support is selectively movable from the first to the second position by the user while in the seated position, in which at least one of the first substantially horizontal member, the second substantially horizontal member, and the user has an adjustable length.

18. The support apparatus of claim 17 in which the support is selectively adjustable to one of a plurality of predetermined heights to accommodate different users.

19. The support apparatus of claim 18 in which the support is adjustable to one of the predetermined heights by adjustably attaching the support to the seating device.

20. The support apparatus of claim 19 in which the pivot arm further comprises a first substantially horizontal member rotatably mountable to the seating device and connectable to a riser by a second attachment means, the height of the support being adjustable by adjusting the second attachment means.

21. The support apparatus of claim 17 in which the support further comprises a cushion.

22. The support apparatus of claim 17 in which the first substantially horizontal member, the second substantially horizontal member, and riser comprise a metal rube or a metal bar.

23. The support apparatus of claim 17 in which two of the first substantially horizontal member, the second substantially horizontal member, and the riser comprise an integral rod.

24. The support apparatus of claim 17 in which the support is movably attachable to the second substantially horizontal member, the first substantially horizontal member being rotatably mountable to the seating device.

25. The support apparatus of claim 4 or 17 in which the first substantially horizontal member forms an approximately 90 degree first angle from a first horizontal plane with the riser.

26. The support apparatus of claim 25 in which the second substantially horizontal member forms an approximately 90 degree second angle with the riser from a second horizontal plane.

27. The support apparatus of claim 17 in which the first substantially horizontal member has an adjustable length.

28. The support apparatus of claim 17 in which the riser has an adjustable length.

29. The support apparatus of claim 28 in which the height of the support is adjustable by adjusting the length of the riser.

30. The support apparatus of claim 29 in which the length of the riser is adjustable by a knob with a groove in the riser for adjusting the length of the riser.

31. The support apparatus of claim 17 in which the support is attached to the pivot arm by a first attachment means.

32. The support apparatus of claim 31 in which the support is moveably attached to the second substantially horizontal member on the riser by a knob engaging a slot in a bracket attached to the support.

33. The support apparatus of claim 17 in which the first position and the second position are 180 apart.

34. A method of supporting a user seated in a seating device, the method comprising:

providing a support apparatus having a a pivot arm rotatably attachable to the seating device, the pivot arm comprising a riser between and first and second substantially horizontal members, the riser having an adjustable length;

a support movably mountable to the pivot arm such that when the support is in a first position, the support is adapted to provide ventral support for the user as the user leans forward to contact the support and when the support is in a second position, the support is adapted to provide dorsal support for the user as the user leans back against the support, rotating the support apparatus such that the support is at the front of the chair so that the user can lean forward to contact the support, the support thus providing ventral support;

leaning forward to contact the support;

rotating the support apparatus such that the support is at a rear of the seating device while seated;

leaning backward to contact the support, the support thus providing dorsal support; and adjusting the length of the riser to change the height of the support for a different user.

35. The method of claim 34 further comprising:

selectively moving the support to one of a plurality of predetermined heights.

36. The method of claim 35 in which the step of changing the height of the support further comprises changing a length of a riser on the pivot arm such that the support apparatus may accommodate different users.

37. The method of claim 36 in which the step of changing the height of the support further comprises adjusting a first attachment means between the support and the riser.

* * * * *

UNITED STATES PATENT AND TRADEMARK OFFICE

CERTIFICATE OF CORRECTION

PATENT NO. : 7,104,606 B2
APPLICATION NO. : 11/043381
DATED : September 12, 2006
INVENTOR(S) : Jerome J. Congleton et al.

It is certified that error appears in the above-identified patent and that said Letters Patent is hereby corrected as shown below:

Col. 8,

In Claim 9, line 38, please change “die” to --the--.

In Claim 12, line 49, please delete the “;” after “riser”.

In Claim 12, line 51, please replace the “;” with a --,--.

Signed and Sealed this

Twelfth Day of December, 2006

JON W. DUDAS
*Director of the United States Patent and Trademark Office*